US012178238B2

(12) United States Patent
Cakan et al.

(10) Patent No.: US 12,178,238 B2
(45) Date of Patent: Dec. 31, 2024

(54) TOBACCO/HERB LOADING DEVICE AND METHOD THEREFOR

(71) Applicant: KIMS INDUSTRY, Daejeon (KR)

(72) Inventors: Sahin Cakan, Istanbul (TR); Keun-Soo Shin, Daejeon (KR)

( * ) Notice: Subject to any disclaimer, the term of this patent is extended or adjusted under 35 U.S.C. 154(b) by 765 days.

(21) Appl. No.: 17/356,971

(22) Filed: Jun. 24, 2021

(65) Prior Publication Data

US 2022/0408795 A1 Dec. 29, 2022

(51) Int. Cl.
*A24C 5/06* (2006.01)
*A24C 5/00* (2020.01)

(52) U.S. Cl.
CPC ..... *A24C 5/06* (2013.01); *A24C 5/002* (2013.01)

(58) Field of Classification Search
CPC .. A24C 5/06; A24C 5/02; A24C 5/393; A24C 5/40; A24C 5/42; A24C 5/54; A24C 5/002; A24C 5/322; A24C 5/34
See application file for complete search history.

(56) References Cited

U.S. PATENT DOCUMENTS

2018/0213838 A1* 8/2018 Richmond ..... A24B 7/04
2020/0010283 A1* 1/2020 Holderman ..... B65B 1/26
2020/0345061 A1* 11/2020 Veelo ..... A47J 42/40

* cited by examiner

*Primary Examiner* — Michael H. Wilson
*Assistant Examiner* — Stephanie Lynn Moore
(74) *Attorney, Agent, or Firm* — Weiss & Moy, PC; Jeffrey D. Moy

(57) ABSTRACT

A device for automated loading and forming smoking articles has a conveyer unit holding and moving a plurality of conical paper wrappers. A dispensing unit is coupled to and positioned above the conveyer unit. The dispensing unit stores pre-grounded tobacco leaf/herbs, loads a predetermined amount of the pre-grounded tobacco leaf/herbs into a designated conical paper wrapper of the plurality of conical paper wrappers, and compacts the pre-grounded tobacco leaf/herbs loaded into the designated conical paper wrapper. The conveyer unit moves the designated conical paper wrapper to a desired location under the dispensing unit to load and compact the predetermined amount of the pre-grounded tobacco leaf/herbs into the designated conical paper wrapper. The conveyer unit then moves a next conical paper wrapper to the desired location after the dispensing unit loads and compacts the predetermined amount of the pre-grounded tobacco leaf/herbs into the designated conical paper wrapper.

16 Claims, 12 Drawing Sheets

TOBACCO/HERB LOADING DEVICE AND METHOD THEREFOR

TECHNICAL FIELD

The present application relates generally to the technical field of tobacco and herbal smoking articles, and more specifically, to the technical field of a device to load a predetermined number of preformed conical paper wrappers with grounded smokable tobacco and/or herbs.

BACKGROUND

Smoking articles such as cigarettes may be formed from paper tubes that are stuffed with finely cut tobacco leaves and/or herbs. Most cigarettes may be manufactured by large tobacco manufacturing companies. However, some people prefer to hand make their own cigarettes rather than purchasing them. Handmade smoking articles, such as cigarettes and the like, is a well-known practice.

In one process, handmade smoking articles may be made by grinding tobacco leaves and/or herbs. Rolling paper may be formed into a cone and used to scoop up small amounts of the grounded smokable tobacco and/or herbs. The maker of the smoking article may then hold the open end of the cone upward allowing small amounts of the scooped up grounded smokable tobacco and/or herbs to fall into the cone. This process continues until a desired amount of ground smokable tobacco and/or herbs is held within the cone. The maker may use a rod or similar object to compact the ground smokable tobacco and/or herbs into the cone. This process is repeated until the cone is filled and compacted with the desired amount of ground smokable tobacco and/or herbs. The open end of the cone is then sealed forming the smoking article. Alternatively, the ground tobacco and/or herbs may be placed on a paper which is then rolled into a tube. A filter may be included in the pre-rolled paper tube or added after to the pre-rolled paper tube.

Unfortunately, rolling individual smoking articles is time consuming. Further, rolling individual smoking articles may cause inconsistency in the smoking articles. This may be due to the smoking articles being unevenly filled and/or compacted with the ground smokable tobacco and/or herbs. Unevenly filling and/or compacting the ground smokable tobacco and/or herbs may adversely affect burn rates and temperatures of the smoking articles. That, in turn, can adversely affect the smoke flavors and result in the generation of unwanted combustion byproducts during the material burn.

Therefore, it would be desirable to provide a system and method that overcomes the above.

SUMMARY

In accordance with one embodiment, a device for automated loading and forming smoking articles device is disclosed. The device has a conveyer unit holding and moving a plurality of conical paper wrappers. A dispensing unit is coupled to and positioned above the conveyer unit. The dispensing unit stores pre-grounded tobacco leaf/herbs, loads a predetermined amount of the pre-grounded tobacco leaf/herbs into a designated conical paper wrapper of the plurality of conical paper wrappers, and compacts the pre-grounded tobacco leaf/herbs loaded into the designated conical paper wrapper. The conveyer unit moves the designated conical paper wrapper to a desired location under the dispensing unit to load and compact the predetermined amount of the pre-grounded tobacco leaf/herbs into the designated conical paper wrapper. The conveyer unit then moves a next conical paper wrapper to the desired location after the dispensing unit loads and compacts the predetermined amount of the pre-grounded tobacco leaf/herbs into the designated conical paper wrapper.

In accordance with one embodiment, a device for automated loading and forming smoking articles device is disclosed. The device has a base. A conveyer unit is coupled to the base and holds and moves a plurality of conical paper wrappers. A dispensing unit is coupled to and positioned above the conveyer unit. The dispensing unit stores pre-grounded tobacco leaf/herbs, loads a predetermined amount of the pre-grounded tobacco leaf/herbs into a designated conical paper wrapper of the plurality of conical paper wrappers, and compacts the pre-grounded tobacco leaf/herbs loaded into the designated conical paper wrapper. A sealing device is coupled to the dispensing unit closing an open end of each of the plurality of conical paper wrappers. A control unit is coupled to the conveyer unit and the dispensing unit. A motor unit is coupled to the control unit, the conveyer unit and the dispensing unit. The control unit rotates the conveyer unit moving the designated conical paper wrapper to a desired location under the dispensing unit and signals the dispensing unit to load and compact the predetermined amount of the pre-grounded tobacco leaf/herbs into the designated conical paper wrapper and rotates the conveyer unit moving a next conical paper wrapper to the desired location after the dispensing unit loads and compacts the predetermined amount of the pre-grounded tobacco leaf/herbs into the designated conical paper wrapper

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
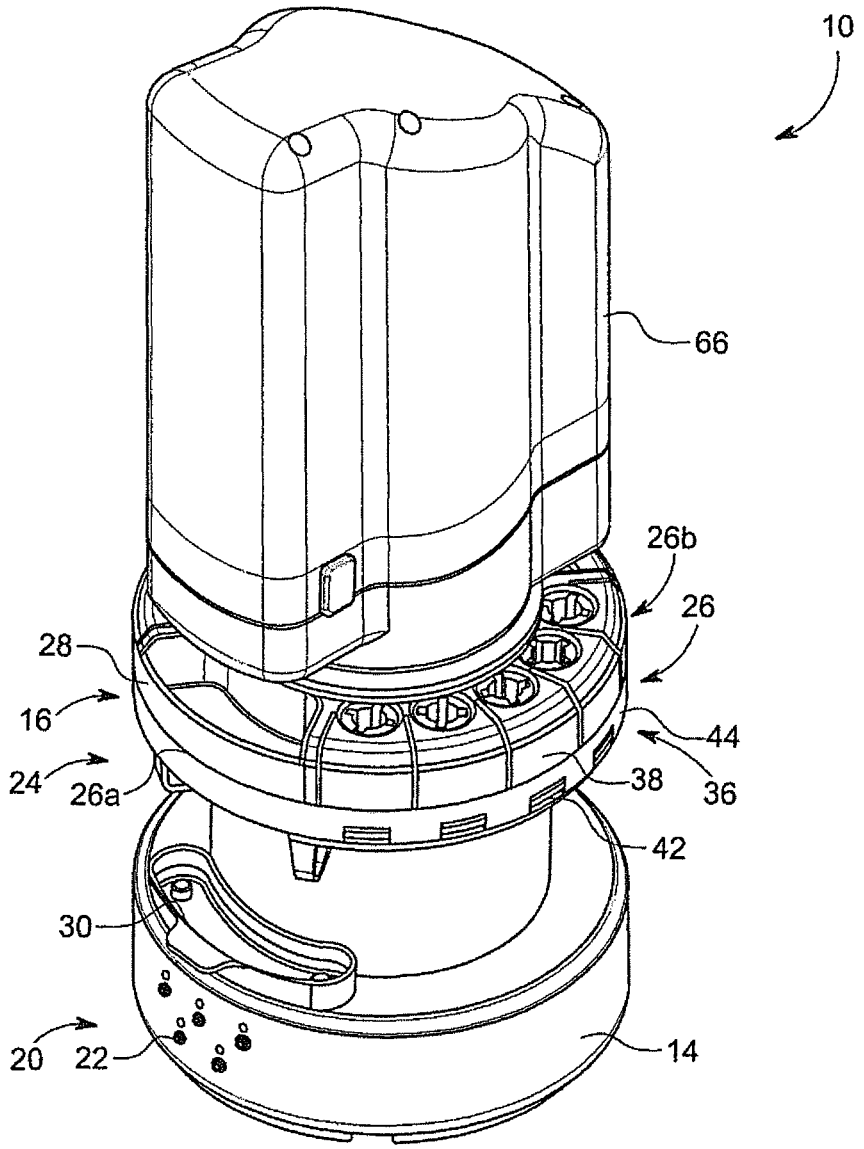
FIG. 1 is an elevated perspective view of an exemplary tobacco leaf/herb cone loading device in accordance with one aspect of the present application.
Figure 2:
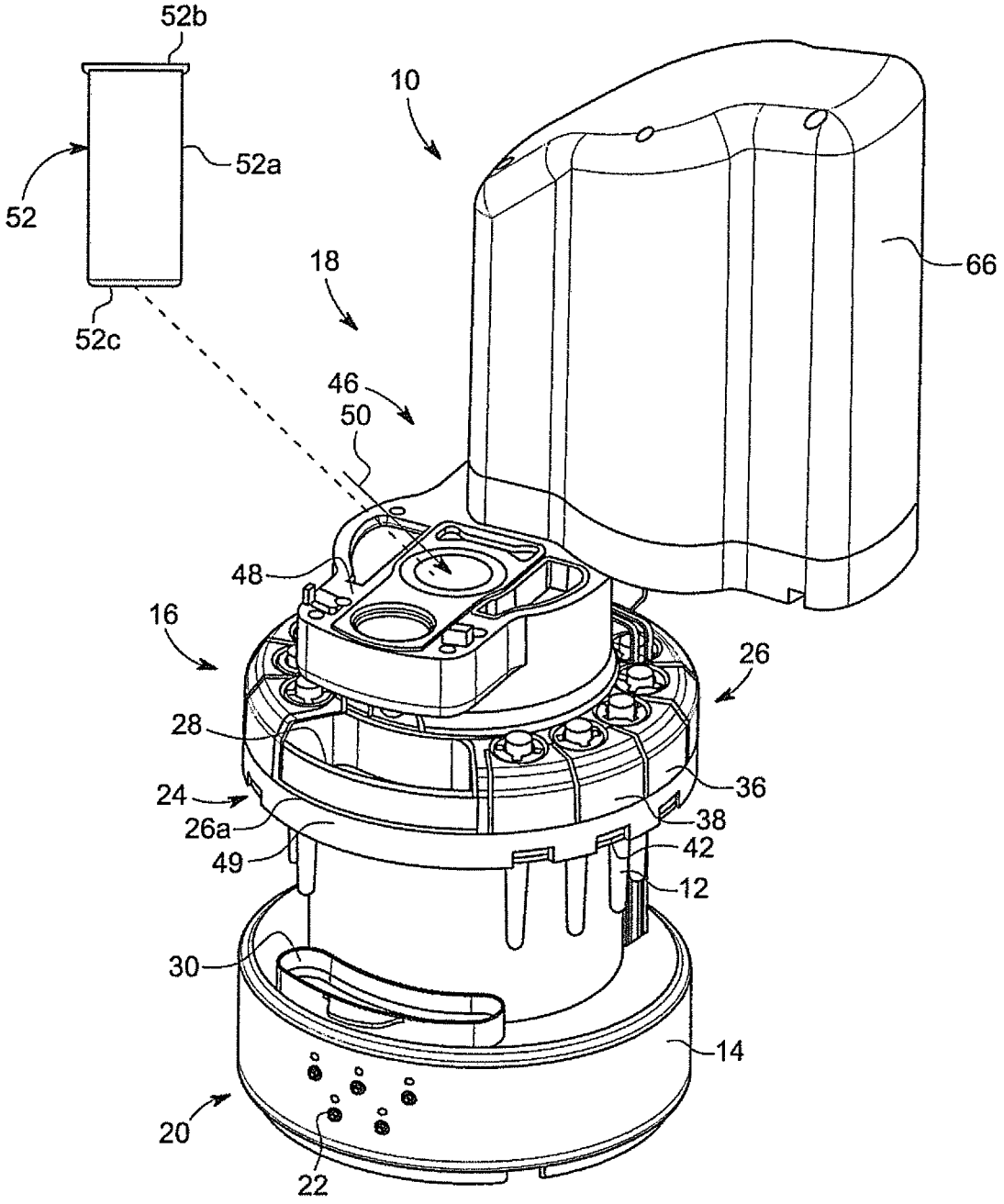
FIG. 2 is an elevated perspective view of the exemplary tobacco leaf/herb cone loading device with a top cover section open in accordance with one aspect of the present application.
Figure 3:
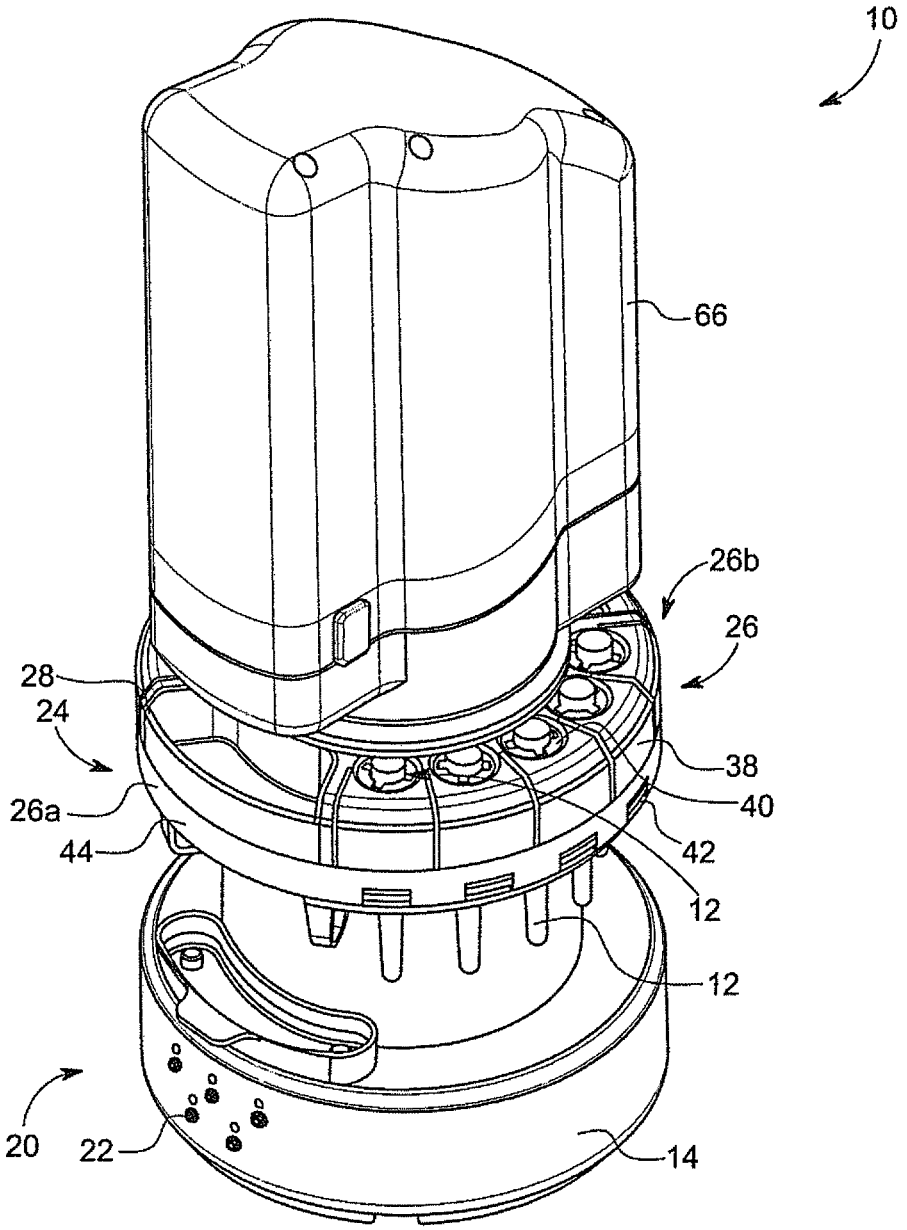
FIG. 3 is an elevated perspective an elevated perspective view of an exemplary tobacco leaf/herb cone loading device with pre-rolled cones loaded in accordance with one aspect of the present application.
Figure 4:
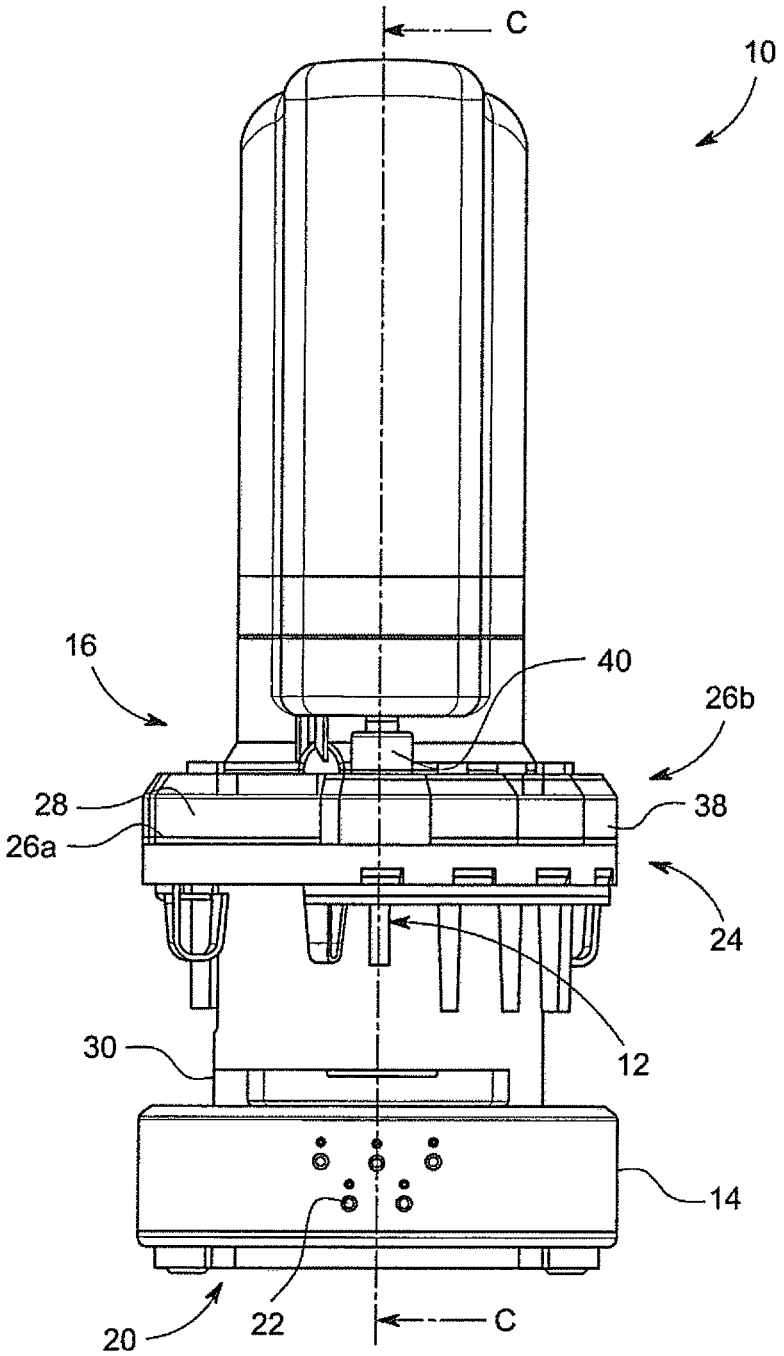
FIG. 4 is a front view of an exemplary tobacco leaf/herb cone loading device in accordance with one aspect of the present application.
Figure 5:
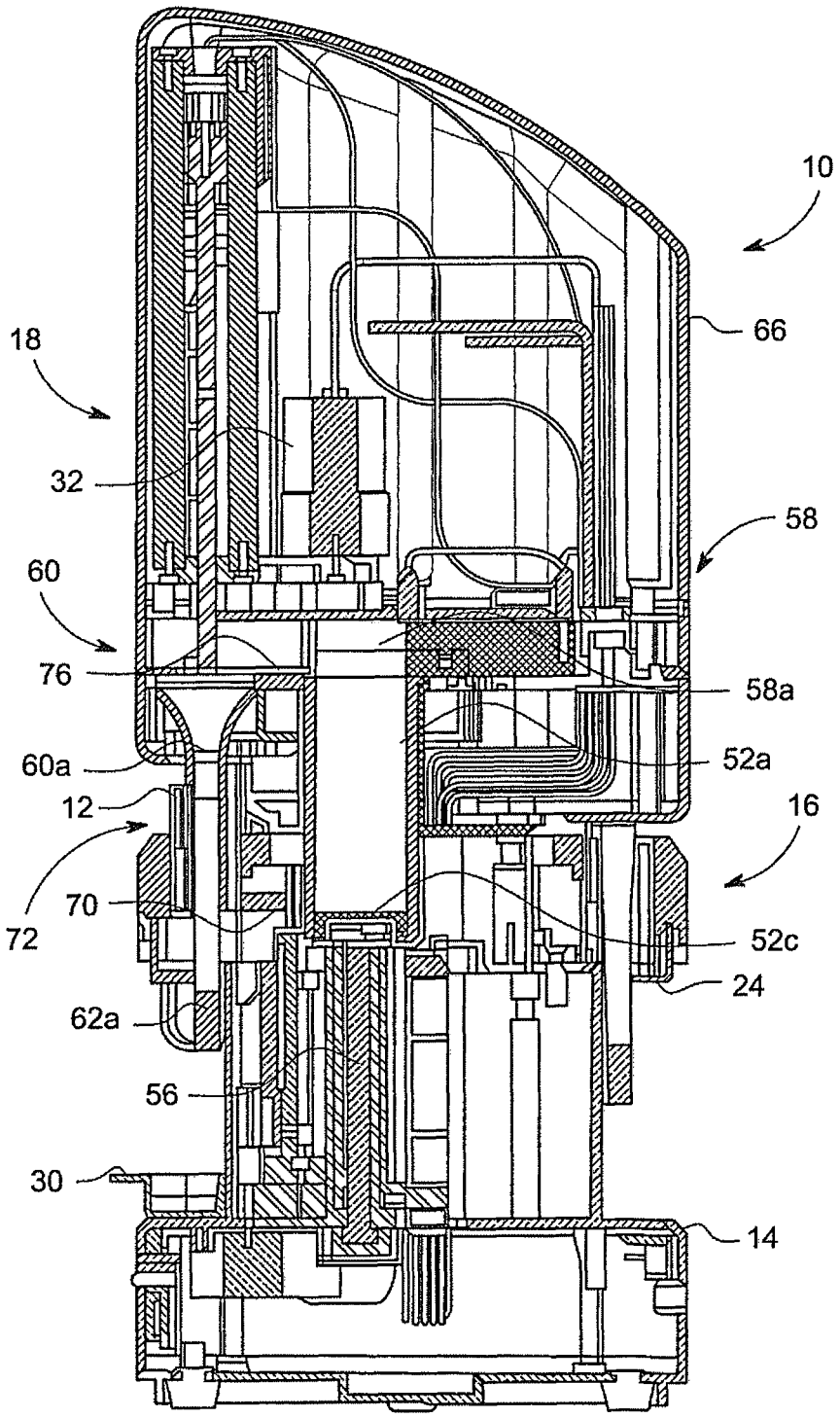
FIG. 5 is a cross-sectional side view of an exemplary tobacco leaf/herb cone loading device taken along lines C-C of FIG. 4 in accordance with one aspect of the present application.
Figure 6:
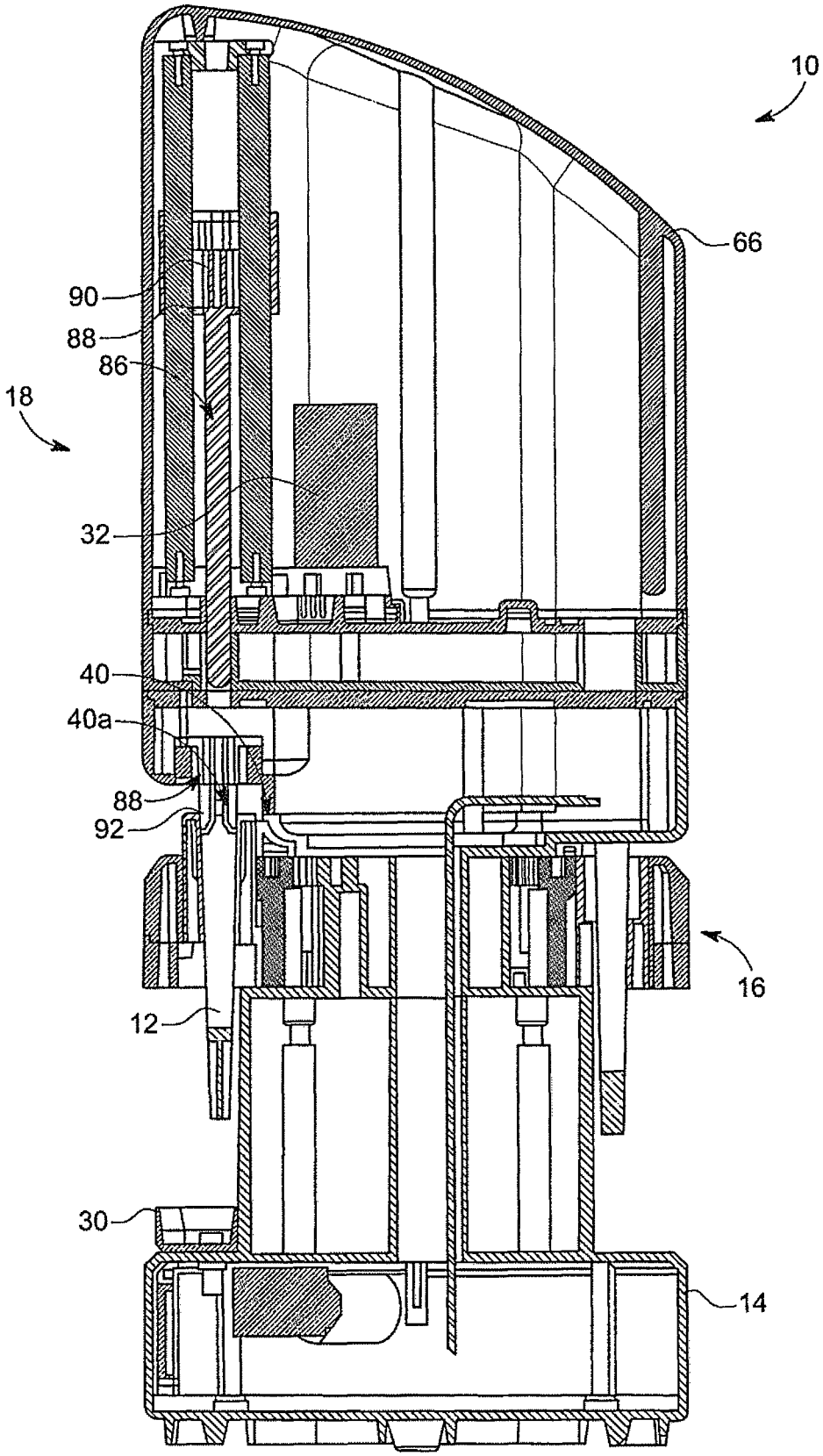
FIG. 6 is a cross-sectional side view of an exemplary tobacco leaf/herb cone loading device in accordance with one aspect of the present application.
Figure 7:
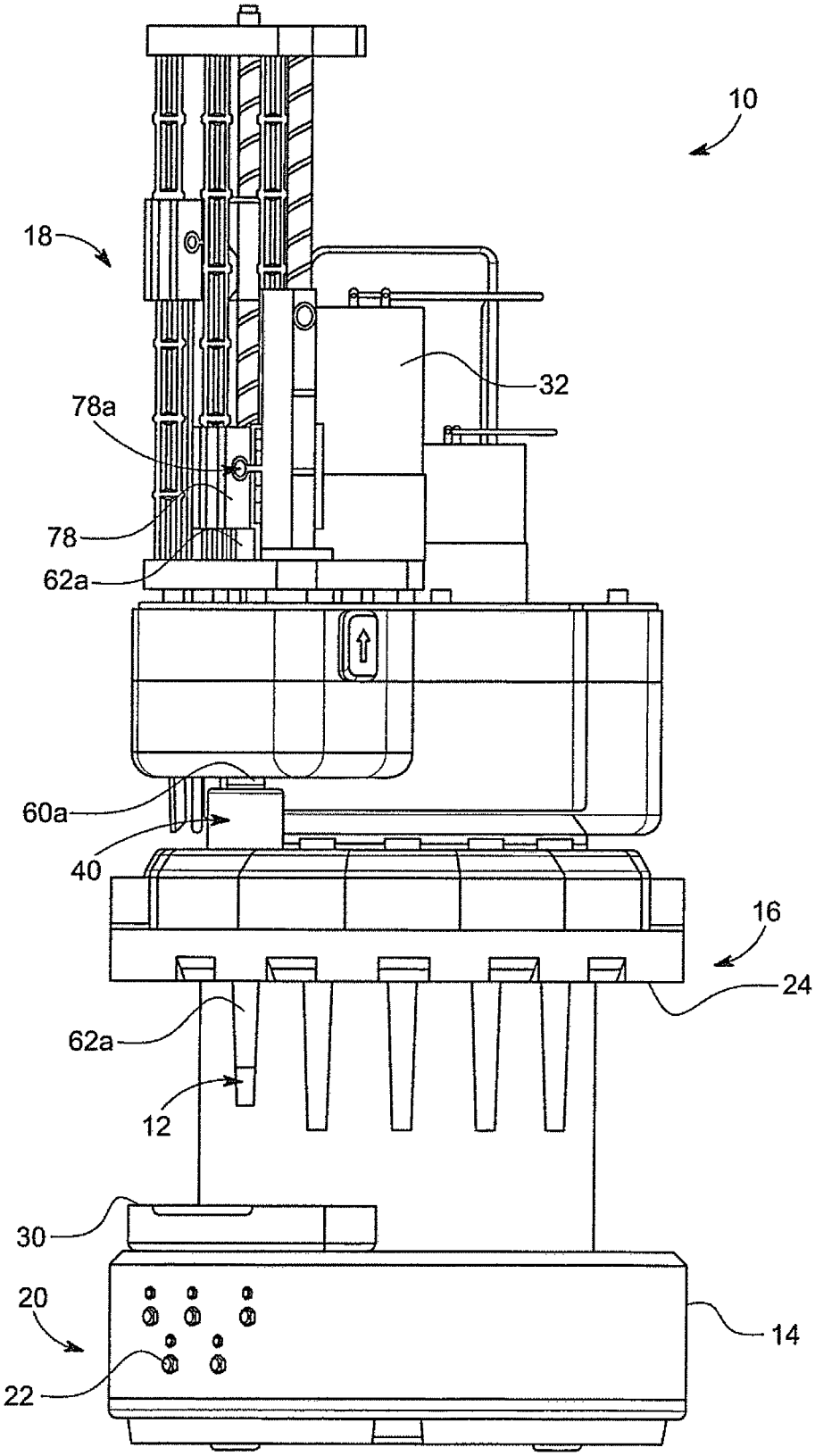
FIG. 7 is a side perspective view of the exemplary tobacco leaf/herb cone loading device with the top cover section removed in accordance with one aspect of the present application.
Figure 8:
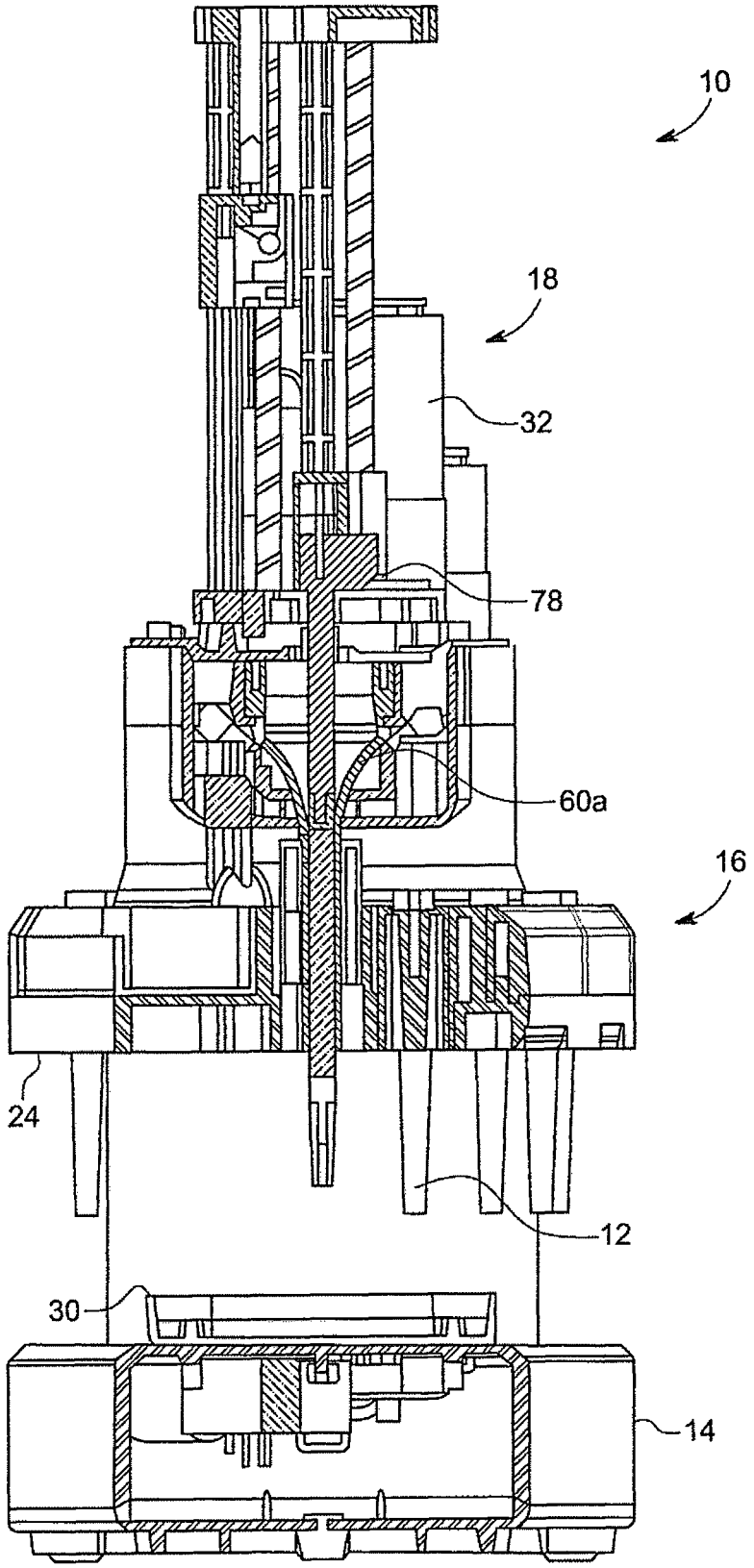
FIG. 8 is a cross-sectional side view of an exemplary tobacco leaf/herb cone loading device in accordance with one aspect of the present application.
Figure 9:
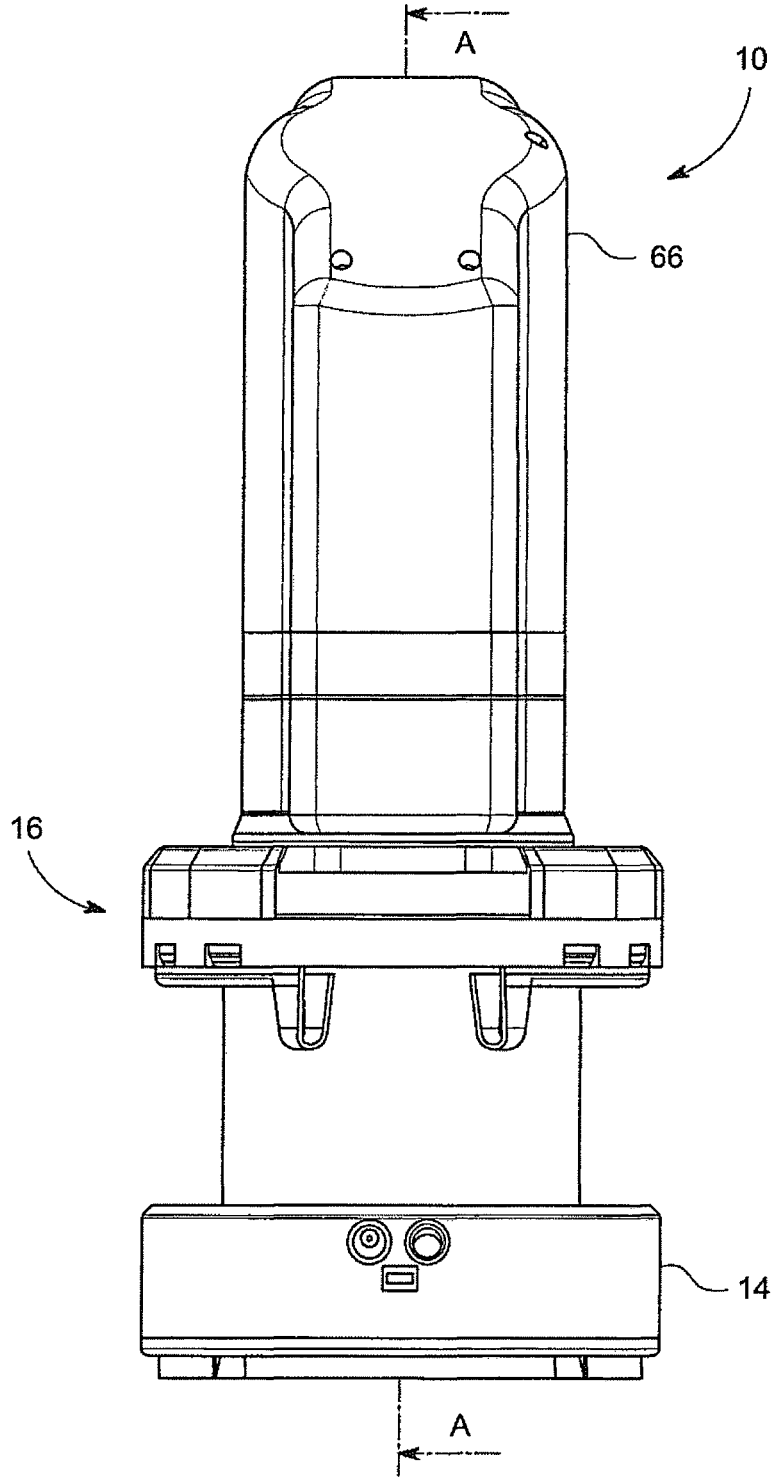
FIG. 9 is a rear view of the exemplary tobacco leaf/herb cone loading device in accordance with one aspect of the present application.
Figure 10:
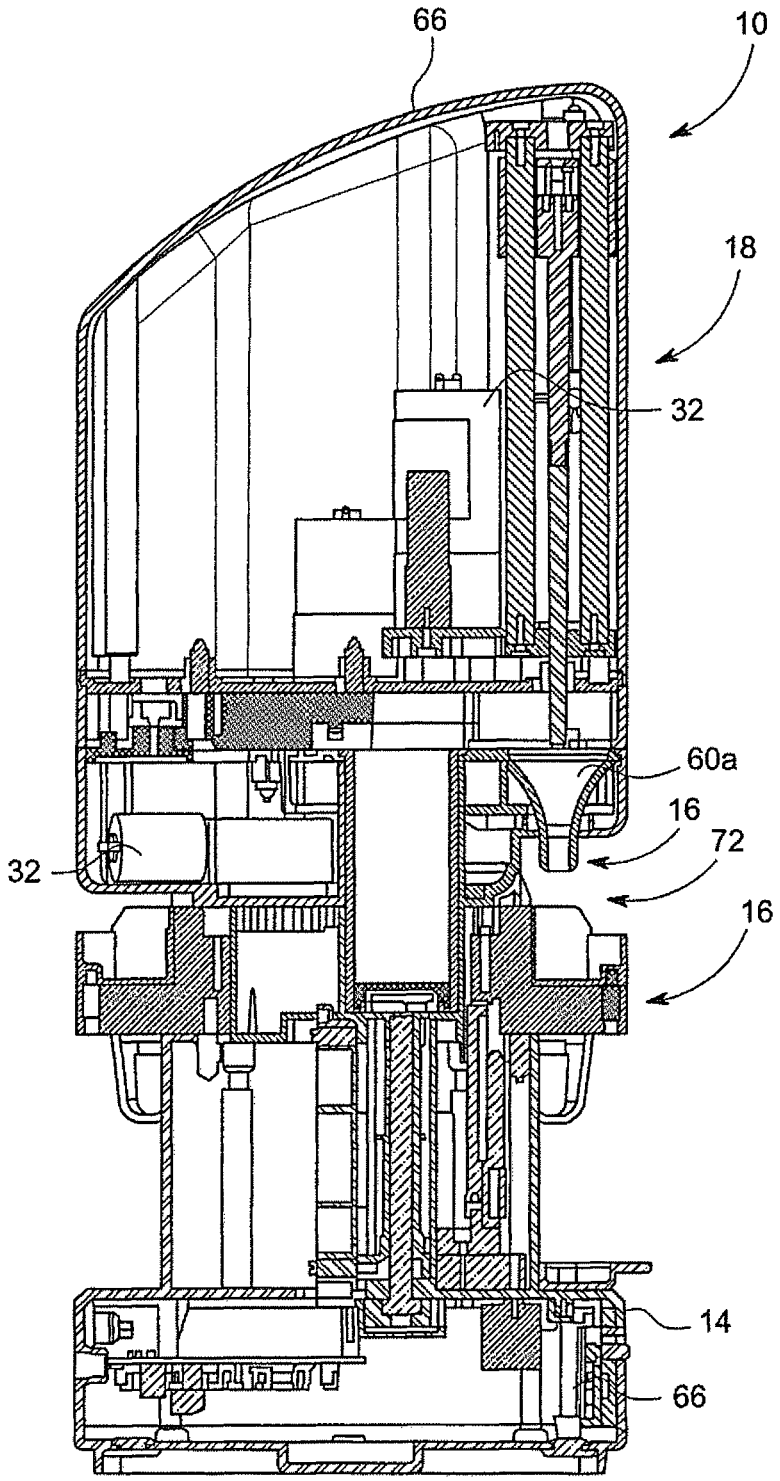
FIG. 10 is a cross-sectional side view of an exemplary tobacco leaf/herb cone loading device in accordance with one aspect of the present application.
Figure 11:
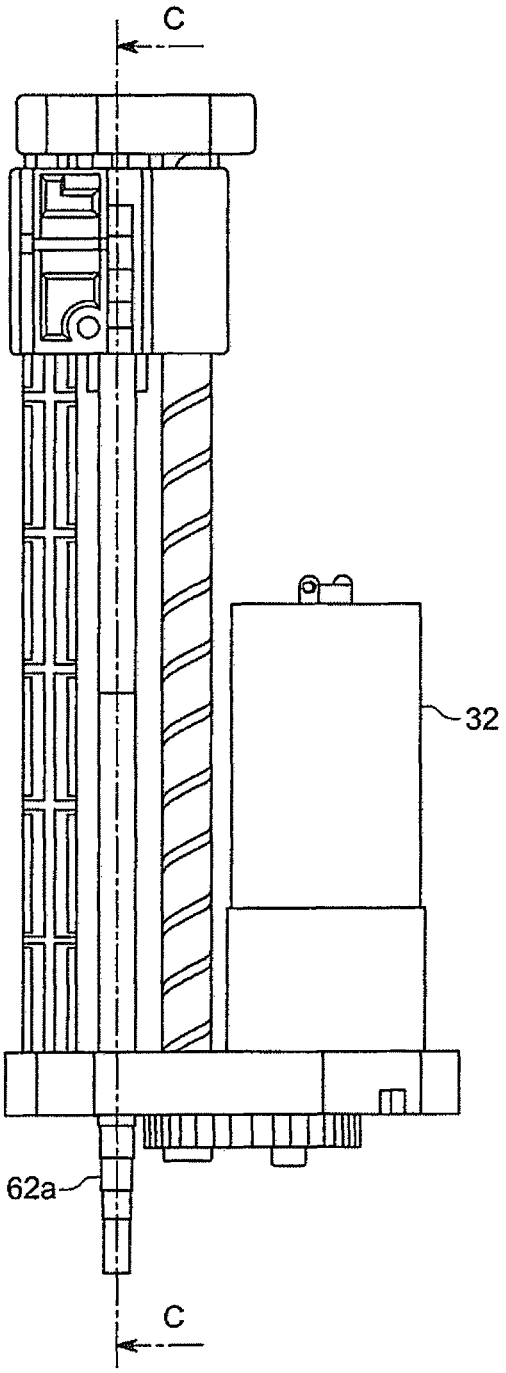
FIG. 11 is a magnified view of an exemplary cone loading unit used in a tobacco leaf/herb cone loading device in accordance with one aspect of the present application.
Figure 12:
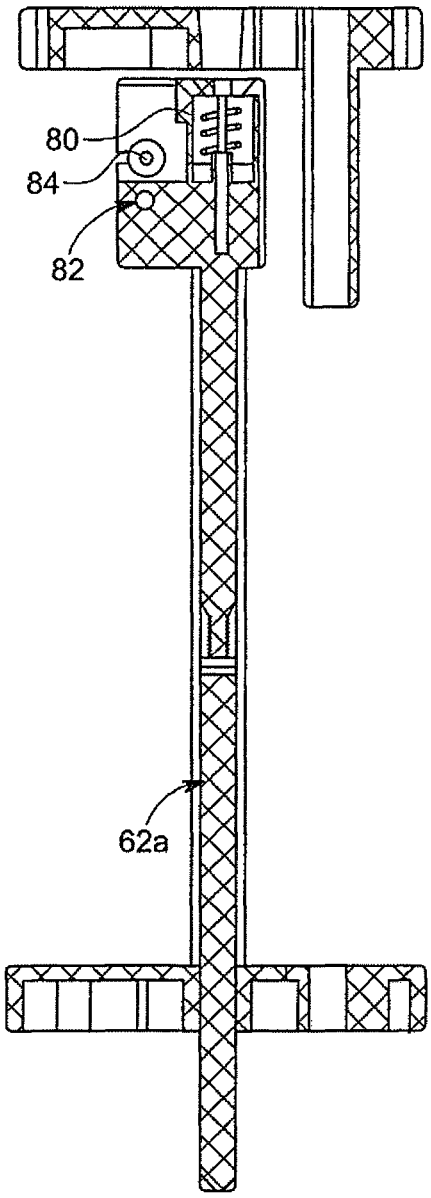
FIG. 12 is a magnified cross-sectional view of an exemplary cone loading unit used in a tobacco leaf/herb cone loading device in accordance with one aspect of the present application.
Figure 13:
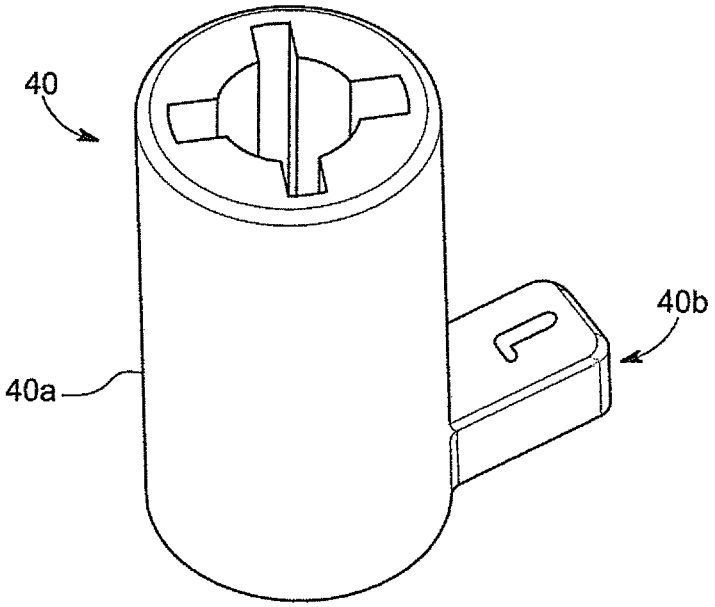
FIG. 13 is a magnified view of an exemplary cone holder used in a tobacco leaf/herb cone loading device in accordance with one aspect of the present application.
Figure 14:
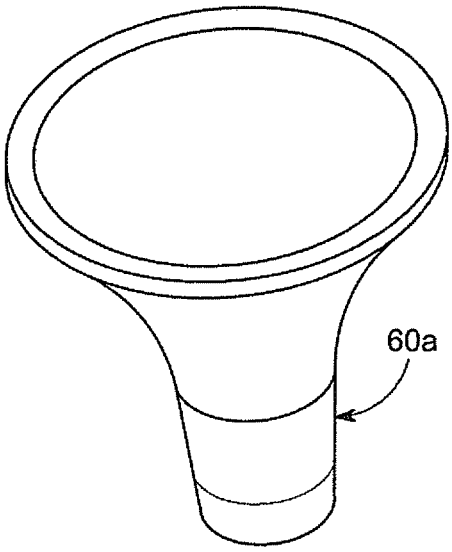
FIG. 14 is a magnified view of an exemplary loading device in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

The present disclosure relates to a device to load pre-grounded tobacco leaf/herb into one or more preformed conical paper wrappers forming one or more smoking articles. The device may allow a user to select the number of smoking articles to form. Once the preformed conical paper wrappers are positioned within the device, the device will rotate each conical paper wrapper to a loading area where the conical paper wrapper is raised, filled and compacted with pre-grounded tobacco leaf/herb. The device then closes an open end of the conical paper wrapper with the filled and compacted pre-grounded tobacco leaf/herb to form the smoking article.

Referring to the FIGs., a device 10 may be seen for loading pre-grounded tobacco leaf/herb into one or more preformed conical paper wrappers 12. The device 10 may be formed of a base 14, a conical paper wrapper conveyor unit 16, and a tobacco leaf/herb dispensing unit 18. A motor unit 32A may be provided to power the device as described below.

The base 14 may be used to support the device 10. The base 14 may come in different geometrical shapes and sizes. Any shape and size may be used as long as the base 14 can support the different components of the device 10 and keep the device 10 in an upright manner. The base 14 may be used to house a control panel 20. The control panel 20 may be used to control the operation of the device 10. The control panel 20 may have one or more control buttons 22 or other control devices. The control buttons 22 may be used to enter control signals which may be used to control operation of the device 10. For example, the control buttons 22 may be used to activate/deactivate the device 10. The control buttons 22 may be used to set the number of conical paper wrappers 12 to be filled by the device 10, a size of the conical paper wrappers 12 or to set an amount of pre-grounded tobacco leaf/herb to be used. The above is given as examples and should not be seen in a limiting manner. The control buttons 22 may be used to control any operating condition of the device 10 other than those described above.

A collection chamber 30 may be formed on a top surface of the base 14. In accordance with the present embodiment, the collection chamber may be formed along an outer perimeter of the base 14. The collection chamber 30 may be used to collect the pre-grounded tobacco leaf/herb that may be released from the tobacco leaf/herb dispensing unit 18 during a loading process that is not loaded into a conical paper wrapper 12.

Positioned on a top central area of the base 14 is the conical paper wrapper conveyor unit 16. The conical paper wrapper conveyor unit 16 may be used to hold one or more conical paper wrappers 12 to be filled by the device 10. The conical paper wrapper conveyor unit 16 may move each conical paper wrappers 12 to a proper position so that the tobacco leaf/herb dispensing unit 18 may load and compact the proper amount of pre-grounded tobacco leaf/herb into a desired conical paper wrapper 12. In accordance with one embodiment, the conical paper wrapper conveyor unit 16 is rotatably coupled to the top area of the base 14.

The motor unit 32A may have one or more motors 32. One motor 32 of the motor unit 32A may be coupled to the conical paper wrapper conveyor unit 16. The motor 32 may be used to rotate the conical paper wrapper conveyor unit 16 about the base 14. In accordance with one embodiment, the motor 32 may be a DC motor. The DC motor may be powered by a power source 34. The power source 34 may be a battery or similar energy source. The motor 32 and the control of the motor 32 may be described in more detail below.

The conical paper wrapper conveyor unit 16 may be formed of a platform 24. In the present embodiment, the platform 24 is a circular platform 24A. While a circular platform 24A may be shown, the platform 24 may come in other shapes. The platform 24 may be rotatably coupled to the base 14 and moved round the base 14 via the motor 32.

The platform 24 may be divided into a plurality of sections 26. Each section 26 may be used to store and hold an item as may be disclosed below. Each of the plurality of sections 26 may have a front side formed along an outer perimeter of the platform 24 and a rear side formed along an inner perimeter of the platform 24. A first section 26A of the plurality of sections 26 may be larger in size than the remaining sections 26B. The remaining sections 26B may be smaller in size than the first section 26A and all approximately equal in size. The first section 24A may be used to hold a trough 28. The trough 28 may be used to collect any of the pre-grounded tobacco leaf/herb that may be released from the tobacco leaf/herb dispensing unit 18.

The remaining sections 26B may be used to hold a cone holding device 36. The cone holding device 36 may be used to hold a conical paper wrapper 12 in an upright positioned within the device 10. In accordance with one embodiment, there may be up to ten (10) cone holding devices 36 in the platform 24. The cone holding device 36 may be formed of a support body 38. The support body 38 may be used to slidably secure a cone holder 40 therewithin. In accordance with one embodiment, the support body 38 may be formed of a rectangular body member 38A.

The cone holder 40 may be slidably coupled to the support body 38. In accordance with one embodiment, the rectangular body member 38 may have a channel 39 formed through a central top area of the rectangular body member 38A. The cone holder 40 may be positioned and slidable within the channel 39. The cone holder 40 may come in different sizes to hold different sized conical paper wrappers 12. In accordance with one embodiment, the cone holder 40 may be a cylindrical member 40A positioned within the channel 39 of the rectangular body member 38A. The cylindrical member 40A may have a conical opening 40B formed within the cylindrical member 40A. The size of the cylindrical member 40A may be based on the size of conical paper wrapper 12 to be held. A locking tab 40B may be formed on a bottom area of the cylindrical member 40A. The locking tab 40B extends through the support 38. The locking tab 40B may engage a notch 42 formed in a lip member 44 formed around an outer perimeter of the platform 24. When the locking tab 40B extends through and engages the notch 42, the cone holding device 36 may be secured to a desired section 26 of the platform 24. By pressing downward and back on the cone holding device 36, the user may release the locking tab 40B from the notch 42.

Coupled to the base 14 and positioned above the conical paper wrapper conveyor unit 16 may be the tobacco leaf/herb dispensing unit 18. The tobacco leaf/herb dispensing unit 18 may be coupled to a central area of the base 14. The central area of the base 14 may be exposed when the platform 24 is a circular platform 24A similar to an "O".

The tobacco leaf/herb dispensing unit 18 may have a storage unit 46. The storage unit 46 may be where the device 10 may store the pre-grounded tobacco leaf/herb which is to be loaded and compacted into the conical paper wrappers 12. The storage unit 46 may be formed of a platform 48 coupled to the base 14. The platform 48 may have a channel 50 formed through a central area thereof. The channel 50 ay be used to hold a storage capsule 52. The storage capsule 52 may be used to store the pre-grounded tobacco leaf/herb which is to be loaded and compacted into the conical paper wrappers 12. In accordance with one embodiment, the capsule 52 may be formed of a tube 52A. The tube 52A may be approximately a same diameter as the channel 50. This may allow the tube 52A to be slid within the channel 50. A lip 52B may be formed around an opening 52D formed at a top of the tube 52A. An outer perimeter of the lip 52B may be larger than the channel 50 thereby holding the capsule 52 within the channel 50.

The capsule 52 may have a movable floor 52C. The floor 52C may move in an up and down manner within the tube 52A as will be described below. The movement of the floor 52C may allow one to dispense the contents, the pre-grounded tobacco leaf/herb, stored within the capsule 52.

The dispensing unit 18 may be used to distribute the pre-grounded tobacco leaf/herb, stored within the capsule 52, and place and compact the pre-grounded tobacco leaf/herb in a designated conical paper wrapper 12. In accordance with one embodiment, the dispensing unit 18 may be used to move the floor 52C in an up and down manner within the tube 52A. By moving the floor 52C upwards, the pre-grounded tobacco leaf/herb, stored within the capsule 52, may be forced out of the opening in the top of the tube 52A. By moving the floor 52C downwards, one may reload the tube 52A with more of the pre-grounded tobacco leaf/herb.

The dispensing unit 18 may have a rod member 56. The rod member 56 may be coupled to the floor 52C of the capsule 52. The rod member 56 may be moved upward or downward thereby moving the floor 52C upwards or downwards within the within the tube 52A. When the rod member 56 moves upwards, the floor 52C is moved upwards, and the contents stored within the tube 52A may be forced out of the opening in the top of the tube 52A. As the rod member 56 is moved downwards, the floor 52C moves downwards within the tube 52A thereby allowing one to reload the tube 52A with more content, the pre-grounded tobacco leaf/herb. The rod member 56 may be moved in different manners. In accordance with one embodiment, the rod member 56 may be moved by a screw structure 54. In this embodiment, the rod member 56 may have threading 56A. The threading 56A of the rod member 56 engages the screw structure 54. One motor 32 of the motor unit 32A may then rotate the rod member 56 in a clockwise or counter-clockwise direction to move the rod member 56 within the screw structure 54 thereby raising and lowering the rod member 56. Alternatively, the rod member 56 may be raised and lowered pneumatically or the rod member 56 may be a telescopic rod member which may be raised and lowered by the motor 32 and/or pneumatically. The above is given as examples and should not be seen in a limiting manner as the rod member 56 may be raised and lowered in other manners.

When the floor 52C moves upwards, the pre-grounded tobacco leaf/herb stored within the capsule 52 may be forced out of the opening in the top of the tube 52A. The dispensing unit 18 may then push the pre-grounded tobacco leaf/herb coming out of the opening in the top of the tube 52A and into a designated conical paper wrapper 12.

In accordance with one embodiment, the dispensing unit 18 has a moving device 58. The moving device 58 may push the pre-grounded tobacco leaf/herb coming out of the opening in the top of the tube 52A to a loading device 60 where the pre-grounded tobacco leaf/herb may be placed in a designated conical paper wrapper 12. The moving device 58 may then return back to a starting position in order to move the next batch of the pre-grounded tobacco leaf/herb coming out of the opening in the top of the tube 52A into the loading device 60.

In accordance with one embodiment, the moving device 58 may be a sliding block 58A. The sliding block 58A may move across the top of the opening in the tube 52A thereby pushing the pre-grounded tobacco leaf/herb coming out of the opening in the top of the tube 52A into the loading device 60 and then return to its original position. The sliding block 58A may be coupled to one motor 32 of the motor unit 32A or an alternative moving device. The motor 32 may be used to move the sliding block 58A. A rotating track, a rod, or similar devices may be coupled to the motor 32 in order to move the sliding block 58A.

The moving device 58 may push the pre-grounded tobacco leaf/herb coming out of the opening in the top of the tube 52A into the loading device 60. The loading device 60 may then direct the pre-grounded tobacco leaf/herb into a designated conical paper wrapper 12. In accordance with one embodiment, the loading device 60 may have be a funnel 60A. The funnel 60A may direct the pre-grounded tobacco leaf/herb directly into the designated conical paper wrapper 12. Different size funnels 60A may be used based on the size of the conical paper wrapper 12 to be loaded.

The dispensing unit 18 may have a compacting device 62. The compacting device 62 may be used to push the pre-grounded tobacco leaf/herb through the funnel 60A, into the designated conical paper wrapper 12 and compact the pre-grounded tobacco leaf/herb in the designated conical paper wrapper 12. In accordance with one embodiment, the compacting device 62 may be a pipe member 62A. The pipe member 62A may move in an up and down manner. The up and down movement of the pipe member 62A nay be used to push the pre-grounded tobacco leaf/herb through the funnel 60A, into the designated conical paper wrapper 12 and compact within the designated conical paper wrapper 12. The pipe member 62A may be slidable coupled to a frame 64. This may allow the pipe member 62A to move in an up and down manner. One motor 32 of the motor unit 32A may be coupled to the pipe member 62A. The motor 32 may be used to move the pipe member 62A in an up and down manner on the frame 64. The above is given as one embodiment. Other devices may be used to move the pipe member 62A may move in an up and down manner.

The device 10 may have a sealing device 86. The sealing device 86 may be used to close the open end of the conical paper wrapper 12 once the conical paper wrapper 12 has been loaded with the pre-grounded tobacco leaf/herbs and compacted. The sealing device 86 may have an arm 88. A proximate end 88A of the arm 88 may be coupled to a movement device 90. A distal end 88B may have a plurality of prongs 92. The movement device 90 may lower the arm member 99 so that the plurality of prongs 92 engage an outer perimeter area of the open top of the conical paper wrapper 12. As the movement device 90 moves the arm 88 further downward, the prongs 92 push the edges of the open-end inward thereby closing the open top of the conical paper wrapper 12 and scaling the pre-grounded tobacco leaf/herbs in the conical paper wrapper 12. In accordance with one embodiment, the movement device 90 may be one motor 32 of the motor unit 32A.

The device 10 may have a control unit 66 coupled to the control panel 20. The control unit 66 may be used to interpret and execute electrical signals from the control panel 20 as well as sensor devices which may be described below.

In operation, a user may use the control panel 20 to select a size and number of conical paper wrappers 12 to load with the pre-grounded tobacco leaf/herb. The user may then load the desired number of conical paper wrappers 12 into the conical wrapper conveyor unit 16. The user may open a cover 66 which is rotatably coupled to the dispensing unit 18. Opening the cover 66 may expose the channel 50 upon which holds the storage capsule 52. The user may then load the pre-grounded tobacco leaf/herb into the storage capsule 52 and close the cover 66.

Using the control panel 20, the user may activate the device 10 to load and compact the desired number of conical paper wrappers 12 with the pre-grounded tobacco leaf/herb. Upon activation, the motor 32 may rotate the conical wrapper conveyor unit 16. The conical wrapper conveyor unit 16 may rotate platform 24 to position a first of the cone holding devices 36 under the funnel 60A of the dispensing unit 18.

One or more position sensors 70 may be used to determine the position of the platform 24. The position sensors 70 may signal when each of the cone holding devices 36 holding a conical paper wrapper 12 is properly positioned under the funnel 60A of the dispensing unit 18. When the cone holding devices 36 is properly positioned under the funnel 60A of the dispensing unit 18, the position sensor 70 may send a signal to the control unit 66. The control unit 66 may then signal the motor 32 to stop rotating the platform 24.

A lifting device 72 may be used to raise and lower the cone holder 40 within the support 38. In accordance with one embodiment, the lifting device 72 may move the cone holder 40 backwards and then upwards. Moving the cone holder 40 back may release the locking tab 40B from the notch 42 thereby allowing the cylindrical member 40A to be raised within the support 38. The lifting device 72 may be any mechanism that may raise and lower the cone holder 40 within the support 38. For example, a lifting arm or similar device may be used. The lifting device 72 may be coupled to the motor 32 and the control unit 66 in order to move and control the operation of the lifting device.

The lifting device 72 may raise the cone holder 40 until the conical paper wrappers 12 is pressed against the loading device 60 of the distribution unit 28. In accordance with one embodiment, the cone holder 40 may be raised until the conical paper wrappers 12 is pressed against the funnel 60A. A sensor 74 may be used to monitor when the conical paper wrappers 12 is pressed against the funnel 60A. Once the sensor 74 monitors that the conical paper wrappers 12 is pressed against the funnel 60A, a signal may be sent to the control unit 66. The control unit 66 may then send a signal to stop the lifting device 72 from raising the cone holder 40. In accordance with one embodiment, the sensor 74 may be a pressure/touch sensor or similar type of device.

Once the cone holder 40 has been raised, the conical paper wrapper 12 that is pressed against the funnel 60A may be loaded and compacted with the pre-grounded tobacco leaf/herb. The dispensing unit 18 may be used to distribute the pre-grounded tobacco leaf/herb stored within the capsule 52, and place and compact the pre-grounded tobacco leaf/herb into the conical paper wrapper 12. The dispensing unit 18 may be used to move the floor 52C in an up and down manner within the tube 52A. By moving the floor 52C upwards, the pre-grounded tobacco leaf/herb, stored within the capsule 52, may be forced out of the opening in the top of the tube 52A. By moving the floor 52C downwards, one may reload the tube 52A with more of the pre-grounded tobacco leaf/herb.

In accordance with one embodiment, the rod member 56 may be moved upward or downward thereby moving the floor 52C upwards or downwards within the within the tube 52A. When the rod member 56 moves upwards, the floor 52C is moved upwards, and the pre-grounded tobacco leaf/herb stored within the tube 52A may be forced out of the opening in the top of the tube 52A. A sensor 76 or similar device may be used to determine when a sufficient amount of the pre-grounded tobacco leaf/herb has been dispensed from the tube 52A. The weight sensor may be coupled to the control panel 20 and the control unit 66. This may allow a user to determine how much pre-grounded tobacco leaf/herb may be placed in each of the conical paper wrappers 12 being loaded.

The moving device 58 may push the pre-grounded tobacco leaf/herb dispensed from the tube 52A into the loading device 60 where the pre-grounded tobacco leaf/herb may be placed in a designated conical paper wrapper 12. In accordance with one embodiment, the sliding block 58A may move across the top of the opening in the tube 52A thereby pushing the pre-grounded tobacco leaf/herb coming out of the opening in the top of the tube 52A into the loading device 60 and then return to its original position.

In accordance with one embodiment, the sliding block 58A may push the pre-grounded tobacco leaf/herb coming out of the opening in the top of the tube 52A into the funnel 60A. The funnel 60A may direct the pre-grounded tobacco leaf/herb directly into the designated conical paper wrapper 12. The compacting device 62 may be used to push the pre-grounded tobacco leaf/herb through the funnel 60A, into the designated conical paper wrapper 12 and compact the pre-grounded tobacco leaf/herb in the designated conical paper wrapper 12. In accordance with one embodiment, the compacting device 62 may be a pipe member 62A. The pipe member 62A may move in an up and down manner. The up and down movement of the pipe member 62A may be used to push the pre-grounded tobacco leaf/herb through the funnel 60A, into the designated conical paper wrapper 12 and compact within the designated conical paper wrapper 12.

The compacting device 62 may have one or more sensors 78. The sensors 78 may be used to ensure that the compacting device 62 compresses the pre-grounded tobacco leaf/herb in each of the conical paper wrappers 12 with a same amount of pressure. The sensors 78 may also be used to ensure that the conical paper wrapper 12 being loaded is present and/or is not broken.

The sensors 78 may include a location sensor 78A. The location sensor 78A may monitor a distance the pipe member 62A may move in a downward manner. If the location sensor 78A monitors that the pipe member 62A has moved past a predefined distance, this may be an indication that there is no conical paper wrapper 12 in the cone holder 40 and/or the conical paper wrapper 12 is broken. The location sensor 78A may then send a signal to the control unit 66 to rotate the conical paper wrapper conveyor unit 16 in order to load the next conical paper wrapper 12.

The sensors 78 may include a pressure sensor 78B. The pressure sensor 78B may be used to compresses the pre-grounded tobacco leaf/herb in each of the conical paper wrappers 12 with a same amount of pressure. In accordance with one embodiment, the pressure sensor 78B may include a spring 80, a magnet 82 and a magnet sensor 84. In this embodiment, when the spring 80 may be located on a top area of pipe member 62A. The pipe member 62A may move downwards until the magnet sensor 84 monitors the magnet 82. This may ensure that each of the conical paper wrappers 12 may be compressed with a same amount of pressure.

Once the conical paper wrapper 12 have been loaded with the pre-grounded tobacco leaf/herb and compacted. The sealing device 86 may be used to close the open end of the conical paper wrapper 12. With the pipe member 62A retracted, the arm 88 of the sealing device 86 may be lowed so that the plurality of prongs 92 engage the outer perimeter area of the open top of the conical paper wrapper 12. As the arm 88 moves further downward, the prongs 92 push the edges of the open-end inward thereby closing the open top of the conical paper wrapper 12 and sealing the pre-grounded tobacco leaf/herbs in the conical paper wrapper 12.

The foregoing description is illustrative of particular embodiments of the application, but is not meant to be a limitation upon the practice thereof. The following claims, including all equivalents thereof, are intended to define the scope of the application.

What is claimed is:

1. A device for automated loading and forming smoking articles comprising:

a conveyer unit holding and moving a plurality of conical paper wrappers; and a dispensing unit coupled to and positioned above the conveyer unit, the dispensing unit storing pre-grounded tobacco leaf/herbs, loading a predetermined amount of the pre-grounded tobacco leaf/herbs into a designated conical paper wrapper of the plurality of conical paper wrappers, and compacting the pre-grounded tobacco leaf/herbs loaded into the designated conical paper wrapper:

wherein the conveyer unit moves the designated conical paper wrapper to a desired location under the dispensing unit to load and compact the predetermined amount of the pre-grounded tobacco leaf/herbs into the designated conical paper wrapper and moves a next conical paper wrapper to the desired location after the dispensing unit loads and compacts the predetermined amount of the pre-grounded tobacco leaf/herbs into the designated conical paper wrapper;

wherein the dispensing unit comprises;

a storage unit holding the pre-grounded tobacco leaf/herbs;

a disbursing device coupled to the storage unit dispensing the pre-grounded tobacco leaf/herbs within the storage unit;

a loading device directing the pre-grounded tobacco leaf/herbs dispensed from the storage unit to the designated conical paper wrapper;

a moving device pushing the pre-grounded tobacco leaf/herbs dispensed from the storage unit into the loading device;

a compacting device pushing and compacting the pre-grounded tobacco leaf/herbs in the designated conical paper wrapper; and a depth sensor coupled to the compacting device allowing the compacting device to monitor if the designated conical paper wrapper has a torn bottom area or missing bottom area.

2. The device of claim 1, comprising a base coupled to the conveyer unit and the dispensing unit.

3. The device of claim 2, comprising a collection area formed on the base.

4. The device of claim 1, comprising a sealing device closing an open end of each of the plurality of conical paper wrappers.

5. The device of claim 1, comprising:

a control unit coupled to the conveyer unit and the dispensing unit; and a motor unit coupled to the control unit, the conveyer unit and the dispensing unit.

6. The device of claim 5, comprising a control panel coupled to the control unit.

7. The device of claim 1, wherein the conveyer unit comprises:

a rotating platform;

a plurality of sections formed around a perimeter of the rotating platform, wherein a first section of the plurality of sections collects the pre-grounded tobacco leaf/herbs; and a cone holding device stored in each remaining section of the plurality of sections.

8. The device of claim 7, wherein the conveyer unit comprises a lifting device raising and lowering the cone holding device.

9. The device of claim 7, wherein the cone holding device comprises:

a support body; and a cone holder slidably coupled to the support body.

10. The device of claim 9, comprising:

a locking tab formed on a bottom of the cone holder;

a lip formed around a perimeter of the rotating platform; and a plurality of notches formed along the lip.

11. The device of claim 1, wherein the storage unit comprises:

a platform;

a channel formed in the platform;

a storage capsule placed within the channel for holding the pie-grounded tobacco leaf/herbs; and a floor movable in an up and down manner within the storage capsule.

12. The device of claim 11, wherein the disbursing device comprises a rod member coupled to the floor, wherein raising of the rod member moves the floor upwards to dispense the pre-grounded tobacco leaf/herbs and lowering the rod member moves the floor downward.

13. The device of claim 11, wherein the moving device is a sliding block moving across a top opening of the storage capsule.

14. The device of claim 1, wherein the loading device is a funnel.

15. The device of claim 1, wherein the compacting device is a rod member moving in an up and down manner.

16. The device of claim 1, comprising a compacting sensor coupled to the compacting device allowing the compacting device to exert a same amount of pressure each time.

* * * * *